US005241844A

United States Patent [19]

Nakanishi

[11] Patent Number: 5,241,844

[45] Date of Patent: Sep. 7, 1993

[54] PACKAGE STOCK DEVICE

[75] Inventor: Kazuo Nakanishi, Uji, Japan

[73] Assignee: Murata Kikai Kabushiki Kaisha, Kyoto, Japan

[21] Appl. No.: 936,329

[22] Filed: Aug. 28, 1992

Related U.S. Application Data

[63] Continuation of Ser. No. 518,795, May 4, 1990, abandoned.

[30] Foreign Application Priority Data

May 12, 1989 [JP] Japan ..... 1-53966[U]
May 17, 1989 [JP] Japan ..... 1-121575

[51] Int. Cl.[5] ..... D06B 3/09

[52] U.S. Cl. ..... 68/5 C; 28/285; 68/5 D

[58] Field of Search ..... 68/5 C, 5 D, 5 E, 8; 28/285, 286; 34/203, 216, 217; 57/281; 198/475.1, 797; 99/477, 360, 362, 371; 134/124, 126, 131

[56] References Cited

U.S. PATENT DOCUMENTS

| | | | |
|---|---|---|---|
| 382,800 | 5/1888 | Dixon | 68/5 D |
| 508,094 | 11/1893 | Duckworth | 68/5 D X |
| 1,074,034 | 9/1913 | Ayres | 198/797 X |
| 1,092,976 | 4/1914 | Cilley | 99/360 X |
| 1,992,753 | 2/1935 | Karlson et al. | 68/5 D X |
| 2,048,749 | 7/1936 | Lydon | 68/5 C X |
| 3,211,275 | 10/1965 | Van Der Winden | 99/362 X |
| 3,343,378 | 9/1967 | Hayman | 68/5 E |
| 3,367,039 | 2/1968 | Jacobsen | 68/5 D X |
| 3,452,448 | 7/1969 | Bradford | 34/203 |
| 3,613,551 | 10/1971 | Reimers | 99/360 |
| 3,875,677 | 4/1975 | McWhirter | 68/5 C X |
| 4,300,367 | 11/1981 | Thorsen | 68/5 D |
| 4,354,549 | 10/1982 | Smith | 99/477 X |
| 4,385,035 | 5/1983 | Akitoshi et al. | 99/362 X |
| 4,984,439 | 1/1991 | Smejda | 68/5 D X |

FOREIGN PATENT DOCUMENTS

| | | | |
|---|---|---|---|
| 1955804 | 5/1971 | Fed. Rep. of Germany | 68/5 D |

*Primary Examiner*—Philip R. Coe
*Attorney, Agent, or Firm*—Spensley Horn Jubas & Jubitz

[57] ABSTRACT

A package stock device in which a plurality of package mounting shelves are arranged within a case through endless chain in such a way as they may be circulated and moved in it, and the case is formed with a supplying port and a discharging port so as to supply the packages onto the mounting shelves and discharge the packages from the shelves. The package stock device may be provided with a steam supplying means.

8 Claims, 9 Drawing Sheets

PACKAGE STOCK DEVICE

This is a continuation of application Ser. No. 07/518,795 filed on May 4, 1990, now abandoned.

FIELD OF THE INVENTION

The present invention relates to a package stock device, and more particularly a package stock device in which a structure of the stock case is improved.

RELATED ART STATEMENT

In general, it is well known in the art that a package for which the winding operation has just finished is temporarily stored before the package is supplied to a subsequent stage such as a twisting stage and the like.

FIGS. 11 and 12 illustrate a conventional type of package stock device. As shown in the drawings, a package stock device 1 is provided with a stock case 3 for defining a space where packages 2 are to be stored, a supplying conveyor 5 for use in transporting the packages 2 to a supplying port 4 at a front side of the case 3, a plurality of package mounting shelves 7 for receiving the packages 2 from the supplying conveyor 5, lifting up or descending them in sequence within the case 3 by the endless chains 6 toward a rear side of the case and storing the packages 2 while operating and a discharging conveyor 9 for receiving the packages 2 from the mounting shelves 7 reached the discharging port 8 at the rear surface of the case 3 and transporting them to a subsequent stage.

The endless chains 6 are arranged such that annular chains are installed in a mountain-shape through seven sprockets 10 and circulated. The endless chains 6 are provided with a plurality of the package mounting shelves 7 of which cross sectional shape is formed in a V-shape so as to mount the packages 2 thereon in an equally-spaced apart relation.

Reference numeral 11 in the figure denotes an overhead conveyor for use in transporting the packages 2 onto the supplying conveyor 5.

In case of the package stock device 1, as shown in FIG. 12, the package mounting shelves 7 after discharging the packages 2 from the discharging port 8 onto the discharging conveyor 9 are kept at their vacant shelves **7*a* until they reach the supplying port 4 and the new packages 2 are supplied again from the supplying conveyor 5. Since the supplying port 4 is arranged at a front side of the stock case 3 and the discharging port 8 is arranged at the rear side of the stock case, the prior art had problems that a clearance between the discharging port 8 and the supplying port 4 is wide, the number of package mounting shelves 7 becoming vacant shelves 7*a* is increased and a storing efficiency of the package stock device 1** is reduced.

While, conventionally, in order to provide a stable quality, an improved quality and a termination of the twisting operation for the packages 2 before supplying the packages 2 having just finished for their winding operation to the package stock device 1 or after storing the packages in the package stock device 1 (for example several packages 2 were stored in a boggie (not shown)), the packages 2 were transported into a separately installed steam processing tank (not shown) together with the boggie, were they were left for a specified period of time and then the steam setting was applied.

Accordingly, the storing of the packages 2 and the steam processing were performed under separate steps. This resulting in performing batch processing and so the prior art also had the problem of taking too much time for the processing operation.

In particular, in these advantages were severe case of the steam processing operation for several kinds of packages 2.

OBJECT AND SUMMARY OF THE INVENTION

In view of the foregoing problems, it is an object of the present invention to provide a package stock device capable of vacant reducing the number of package mounting shelves and further increasing a storing efficiency of the package.

It is another object of the present invention to provide a package stock device capable of performing continuous processing of package stock and steam processing so as to enable processing times to be shortened and at the same time easily accommodating the steam processing of various kinds of packages.

In order to accomplish the above-mentioned object one embodiment of, the present invention relates to a package stock device in which a plurality of package mounting shelves are arranged within a case through endless chains in such a way as they may be circulated and moved in it, wherein the case is formed with a supplying port and a discharging port adjacent to a rear side of an advancing direction of the chains so as to supply the packages onto the mounting shelved and discharge the packages from the shelves, and a supplying conveyor and a discharging conveyor for use in transporting the packages are arranged adjacent to these supplying and discharging ports.

The package mounting shelves are fixed to the endless chains. Therefore the package mounting shelves, after discharging the packages from the discharging port onto the discharging conveyor, become vacant shelves until they reach the supplying port and new packages are supplied again from the supplying conveyor. The discharging port is formed adjacent to a rear side of the supplying port in an advancing direction of the chains and thus the number of vacant package mounting shelves positioned between the discharging and supplying ports is reduced and a storing efficiency of the package stock device is increased.

Another embodiment of the present invention provides a package stock device in which a plurality of package mounting shelves are arranged within a case in such a way as to be circulated and moved through endless chains. A steam supplying means is provided within the case so as to perform steam processing of the packages mounted on the mounting shelves while the shelves are circulated and moved.

The packages are supplied in sequence onto the package mounting shelves and stocked within the case until they are circulated and moved by the endless chains and discharged from the case. During this time, steam is supplied from the steam supplying means arranged in the case into the case, whereby the storing of the packages and the steam processing are carried out simultaneously during the circulation and moving operation. New packages are supplied in sequence onto the mounting shelves, resulting in that a continuous processing of packages can be carried out and their processing time may also be shortened.

In addition, if several kinds of packages are mounted on each of the package mounting shelves under a specified classification, and if the time for the circulation and moving operation or the number of times for circulating and moving the specified packages are adjusted in compliance with each of the kinds of packages, the present invention may easily accommodate steam processing for several kinds of packages.

DETAILED DESCRIPTION OF PREFERRED EMBODIMENT

Referring now to the accompanying drawings, one preferred embodiment of the present invention will be described in detail.

Figure 5:
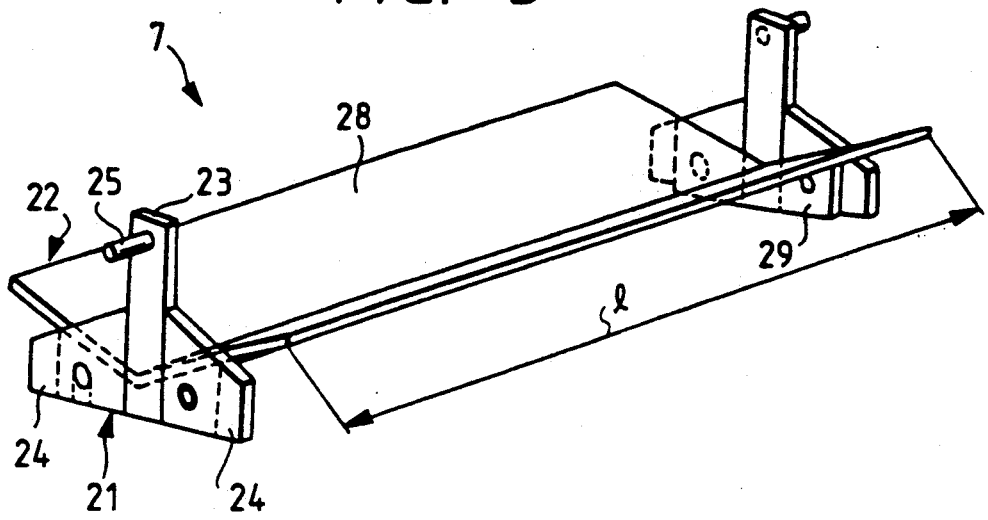
FIG. 5 is a perspective view for showing a package mounting shelf to be employed in the package stock device.
Figure 6:
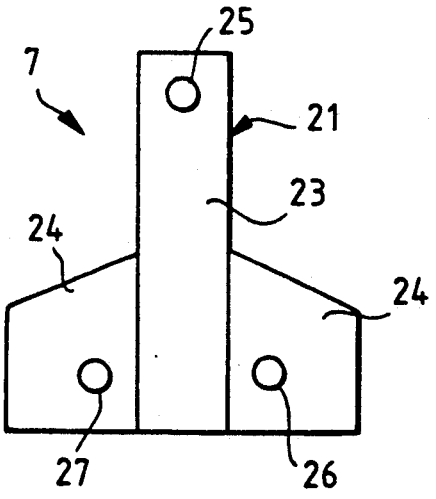
FIG. 6 is a side elevational view for showing a hanger member of the package mounting shelf.
Figure 7:
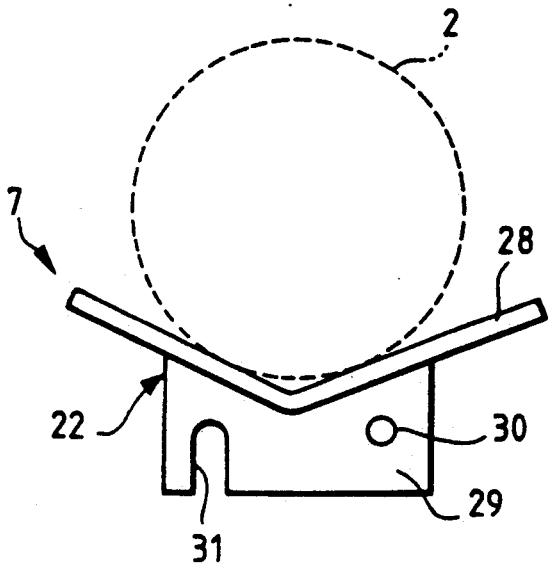
FIG. 7 is a side elevational view for showing a mounting member of the package mounting shelf.
Figure 8:
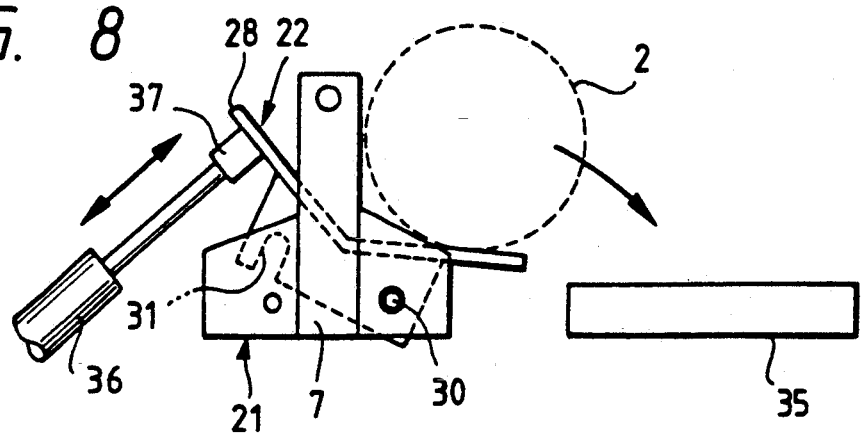
FIG. 8 is an illustrative view for showing a package discharged state from the package stock device.

As illustrated in FIGS. 1 to 4, a space for use in storing the packages 2 of the package stock device 20 of the present invention is defined by a stock case 3 of a hollow rectangular parallelpiped. At both sides within the case 3 are arranged endless chains 6 in which annular chains are formed in to a mountain-shape through seven sprockets 10, circulated and moved in the case. One of the sprockets 10 is provided with a driving device (not shown). To the endless chains 6 arranged at both sides within the case 3 are hung and fixed a plurality of package mounting shelves 7 for use in mounting the packages 2. As shown in FIGS. 5 to 7, the package mounting shelves 7 are comprised of hangers 21 for use in hanging the mounting shelves 7 to the endless chains 6 and of mounting portions 22 for use in mounting the packages 2. The hanger 21 is comprised of a main body 23 a of straight shape and wide-expanded members 24 having a trapezoid shape expanded at both lower sides of the main body 23. The upper part of the main body 23 of the hanger is formed with a fixing pin 25 for use in fixing the hanger part 21 to the endless chain 6 adjacent to the side wall of the case 3. In addition, a supporting hole 26 is formed at a front side of each of the expanded width members 24 and an engaging pin 27 is formed at a rear surface adjacent to an inside part of the case 3. The mounting part 22 is comprised of a shelf member 28 having a cross sectional shape V in order to mount the package, and of supporting members 29 for fixing the shelf member 28 to the hanger part 21. A longitudinal length of the case 3 is decided by a longitudinal length l of the shelf member 28 and the length l of this shelf member 28 is defined by the number of longitudinal rows of packages 2 mounted at once. The supporting members 29 are arranged flush with the longitudinal both ends of the shelf member 28, a supporting pin 30 is passed through the supporting hole 26 of the hanger part 21 and a recess 31 engaged with an engaging pin 27 of the hanger 21. That is, as shown in FIG. 5, the mounting part 22 is fixed while being held by the hanger member 21 and the mounting part 22 is rotated toward the front side of the case 3 by a method wherein the recess 31 is removed from the engaging pin 27 around the supporting pin 30 as shown in FIG. 8.

In addition, an upper part of the front side of the case 3 is formed with a supplying port 32 for supplying the package 2 within the case 3, and the lower part of it is provided with a discharging port 33 for discharging the package 2 from within the case 3. That is, the discharging port 33 is formed adjacent to a rear side of an advancing direction D of the endless chain 6 of the supplying port 32. These supplying and discharging ports 32 and 33 have a larger opening width S than a diameter R of the package 2 and have a larger opening length W than the length ( of the shelves 28 of the package mounting shelves 7. In case of the preferred embodiment, the supplying port 32 and the discharging port 33 are arranged at the same side of the case 3 and arranged adjacent to each other through a shelf hanging pitch P of about two mounting shelves 7. The supplying port 32 is provided with a supplying conveyor 34 for use in transporting the package 2 just finished for its winding operation to the supplying port 32. The discharging port 33 is provided with a discharging conveyor 35 for transporting the packages 2 stocked within the case 3. As shown in FIG. 8, a shelf pusher 36 acting as a driving means for use in rotating the mounting part 22 for the package mounting shelf 7 around the supporting pin 30 to the front side of the case 3 is arranged near the discharging port 33 within the case 3. A hydraulic or neumatic cylinder, for example, is employed as this shelf pusher 36, and a piston rod 37 of this cylinder pushes up the rear surface side of the shelf member 28 from lower side.

An over-head conveyor 11 for use in transporting the packages 2 just finished for winding operation onto the supplying conveyor 34 is arranged at a pre-stage of a winding unit of the supplying conveyor 34. A delivery of the package from the over-head conveyor 11 onto the supplying conveyor 34 is carried out by a method wherein the guide plate 39 installed within the conveyor box 38 is inclined toward the supplying conveyor 34. The supplying conveyor 34 of the conveyor box 38 is provided with an opening or closing gate 40 for use in opening or closing a side wall of the conveyor box so as to transport the packages 2 from within the conveyor box 38 one by one onto the supplying conveyor 34. In addition, an edge part of the supplying conveyor 34 is provided with a stopper 41 for preventing the packages 2 transported through the over-head conveyor 11 from falling off the conveyor. When the packages 2 fed from the over-head conveyor 11 are placed at the position of the stopper 41, the opening or closing gate 40 is closed so as to cause a next package 2 to be waited within the conveyor box 38 and this gate 40 is released to open so as to feed in the waiting package when the package 2 is moved from the position of the stopper 41 on the supplying conveyor 34.

Figure 9:
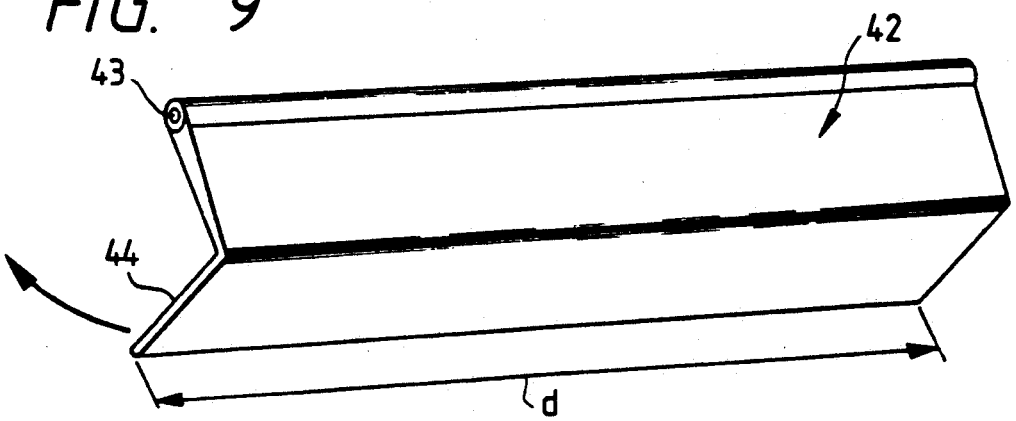
FIG. 9 is a perspective view for showing a pusher to be employed in the package stock device.
Figure 10:
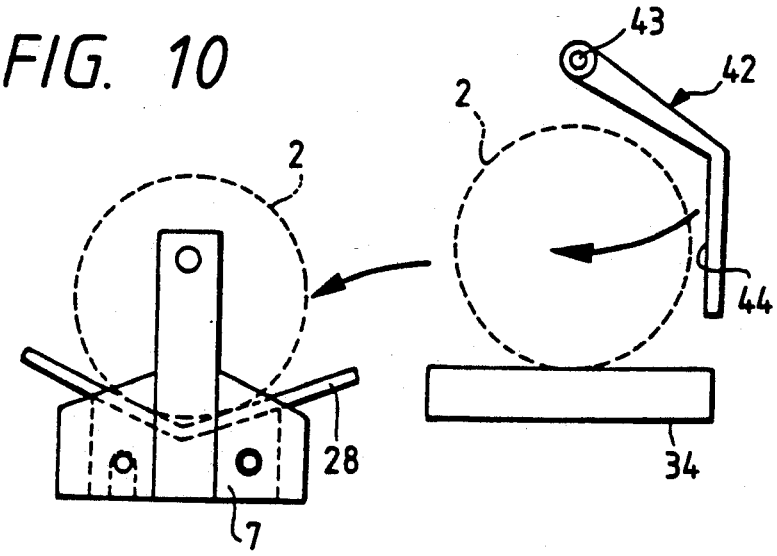
FIG. 10 is an illustrative view for showing a package supplying state for the package stock device.
Figure 11:
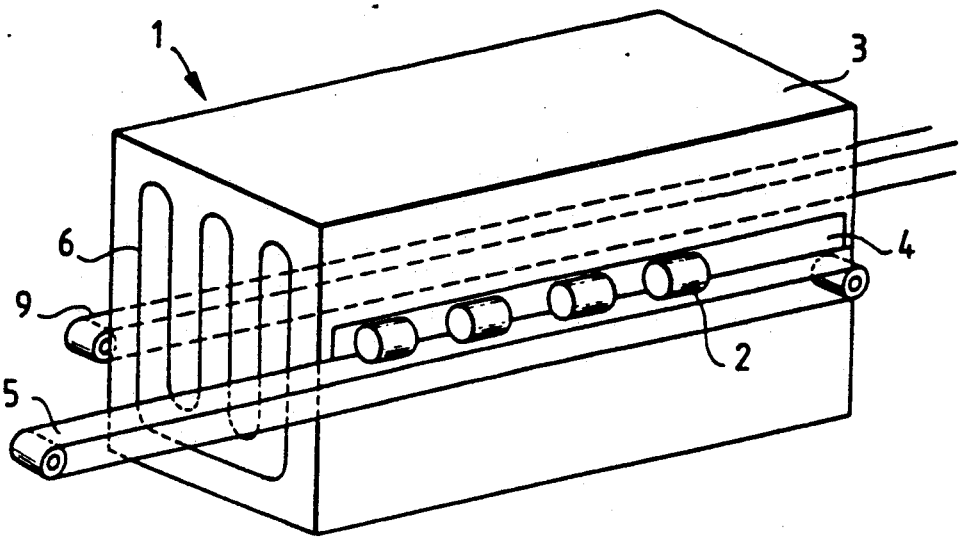
FIG. 11 PRIOR ART
FIG. 11 is a perspective view for showing the conventional type of package stock device.
Figure 12:
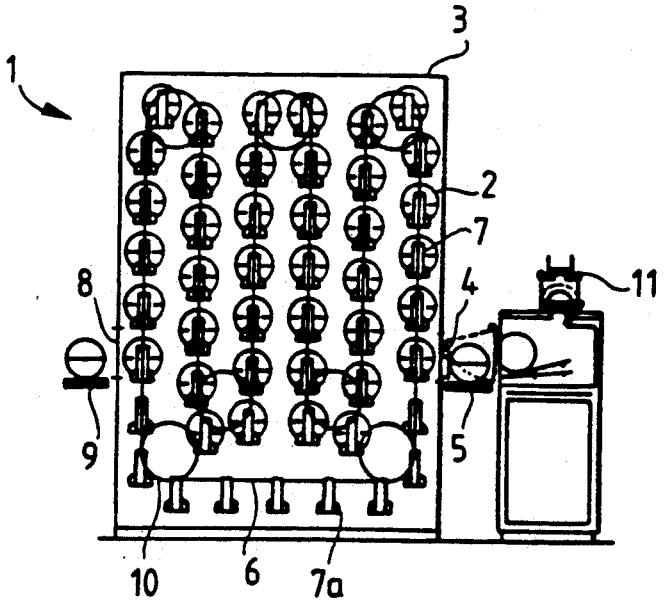
FIG. 12 PRIOR ART
FIG. 12 is a side elevational view for showing the conventional type of package stock device.

As shown in FIGS. 9 and 10, the packages 2 are transported in sequence on the supplying conveyor 34 just before the supplying port 32 for the supplying conveyor 34 as described above, and there is provided a package pusher 42 for supplying these groups of packages 2 onto the mounting shelf at once when the packages 2 mounted on the package mounting shelves 7 are arranged in a longitudinal row just before the supplying port 32. This pusher 42 has a cross sectional shape formed into a < -shape and its upper end is provided with a rotating shaft 43. As this rotating shaft 43 is rotated by a driving means not shown, a pushing piece 44 of the pusher 42 may supply a plurality of packages 2 at once onto the mounting shelves 7. A longitudinal length (d) of the pusher 42 is made to have the same length as the longitudinal length ( of the shelf 28.

Action of the preferred embodiment of the present device will be described as follows.

Figure 1:
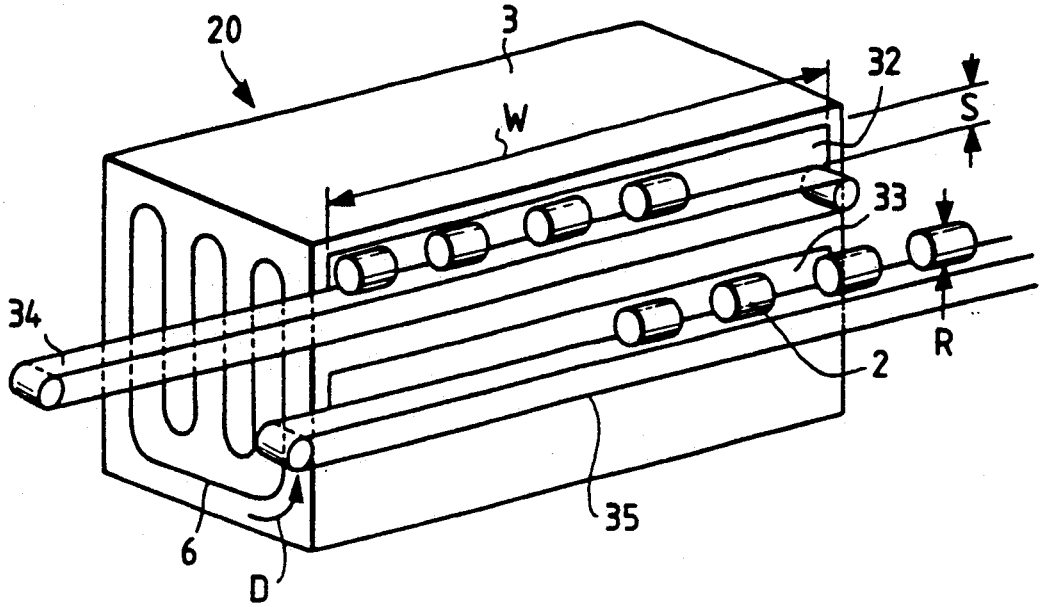
FIG. 1 is a perspective view for showing one preferred embodiment of a package stock device of the present invention.
Figure 2:
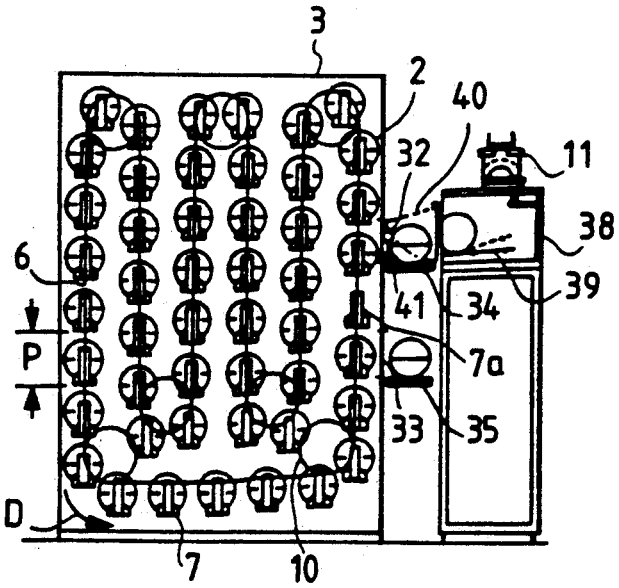
FIG. 2 is a side elevational view for showing one preferred embodiment of a package stock device of the present device.
Figure 3:
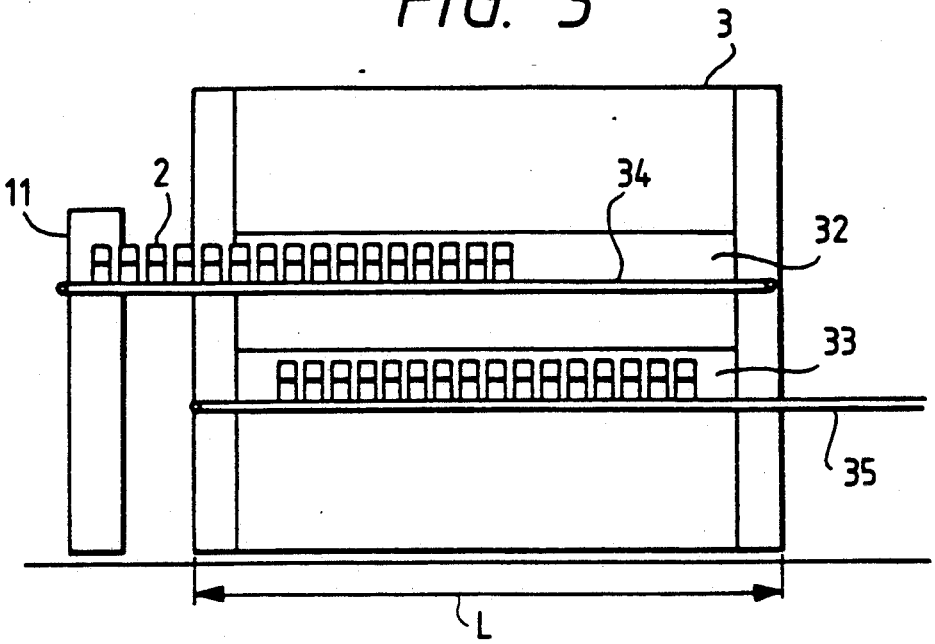
FIG. 3 is a front elevational view for showing the embodiment of the package stock device.
Figure 4:
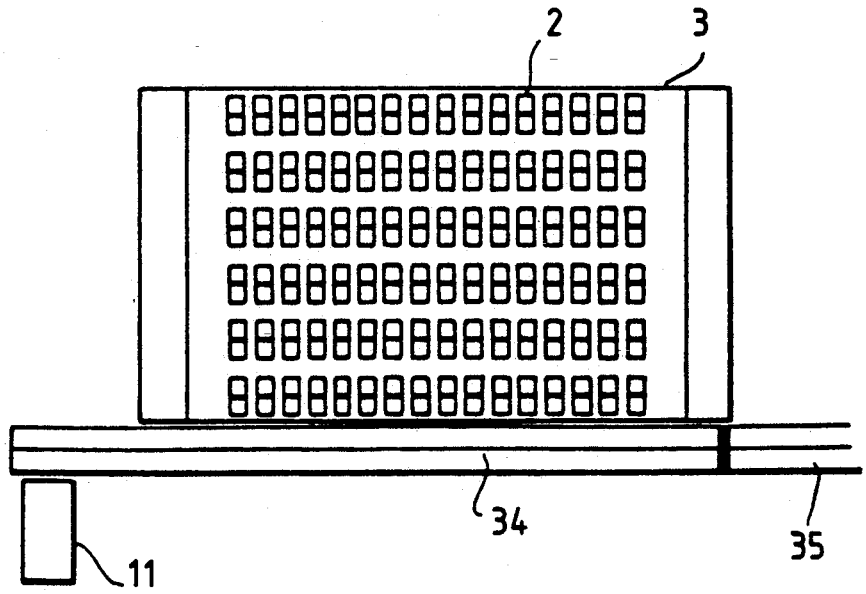
FIG. 4 is a top plan view for showing the embodiment of the package stock device.

As shown in FIG. 2, the packages 2 transported from the winder and the like onto the over-head conveyor 11 are dropped onto the inclining plate 39 and transported to the supplying conveyor 34 from within the conveyor box 38 due to an inclination of the inclining plate. The opening or closing gate 40 provided at the conveyor box 38 is released when the packages 2 are transported from the box 38 onto the supplying conveyor 34 and closed just after it. The stopper 41 provided at the supplying conveyor 34 may prevent the packages 2 from rolling off the supplying conveyor 34 during transportation. The opening or closing gate 41 is kept closed while the packages 2 are positioned at the stopper 41, and a subsequent package 2 is waited within the conveyor box 38. When the package 2 placed at the position of the stopper 41 is moved on the supplying conveyor 34, the opening or closing gate 41 is released to open and the waiting package 2 is transported from within the conveyor box 38 onto the supplying conveyor 34. In this way, the packages 2 are transported in sequence on the supplying conveyor 34 and as the packages 2 to be mounted on the package mounting shelves 7 are arranged in a longitudinal row just before the supplying port 32, as shown in FIG. 10, the package pusher 42 may push these groups of packages 2 at once and the packages are supplied onto the mounting shelves 7. The mounting shelves 7 having groups of packages 7 thereon are circulated and moved within the case 3 by the endless chains 6 formed in a mountain shape while ascending or descending in sequence within the case 3. The endless chains 6 are provided with a plurality of package mounting shelves 7, a plurality of packages 2 are mounted in sequence onto each of the mounting shelves 7, circulated and moved within the case 3. Then, the packages are circulated and moved by about one circumference within the case 3 and then the package mounting shelves 7 having the packages 2 thereon reach the discharging port 33. When the package mounting shelves 7 reach the discharging port 33, as shown in FIG. 8, the shelf pusher 36 may push up from below the rear surface side of the shelf member 28 of the package mounting shelf 7. Then, the mounting part 22 of the package mounting shelf 7 is rotated toward a front surface of the case 3 around the pivoting point of the supporting pin 30 and the groups of packages 2 mounted on the mounting shelves 7 are discharged onto the discharging conveyor 35 at once. That is, the packages 2 are stored within the case 3 while being mounted on the package mounting shelves 7, circulated and moved within the case 3. The packages 2 discharged onto the discharging conveyor 35 are transferred to a subsequent stage such as a twisting stage and the like.

As described above, the package mounting shelves 7 are fixed to the endless chains 6 and circulated within the case 3. The package mounting shelves 7 after discharging the packages 2 onto the discharging conveyor 35 from the discharging port 33 reach the supplying port 32 and they become vacant shelves **7*a* until the packages 2 are supplied again from the supplying conveyor 34. However, as shown in FIG. 2, the package stock device 20 of the present device is constructed such that the discharging port 33 is formed adjacent to the rear side of an advancing direction D of the endless chain 6 for the supplying port 32, so that the number of vacant shelves 7*a* positioned between these discharging port 33 and supplying port 32 is reduced. More practically, the supplying port 32 and the discharging port 33 are arranged at the same side as that of the case 3 and they are arranged adjacent to each other with a shelf hanging pitch P of about two mounting shelves 7. Accordingly, in case of the preferred embodiment, only one package mounting shelf 7 acting as a vacant shelf 7*a* is found between the supplying port 32 and the discharging port 33. If the supplying port 23 and the discharging port 33 are arranged adjacent to each other with a hanging pitch P of about one shelf of the mounting shelves 7, it is possible to completely eliminate an occasion that the mounting shelf 7 becomes a vacant shelf 7*a*. In this way, the package stock device 20 of the present device may increase a storing efficiency of the package stock device 20 due to the fact that the number of vacant shelves 7*a*** is reduced.

In brief, according to an embodiment of the present invention, it may provide some superior effects that the number of vacant package mounting shelves can be reduced and a storing efficiency of the packages can be increased.

Another embodiment of the present invention in which a steam supplying means is provided within the case so as to perform a steam processing the package mounted in the mounting shelves will be illustrated hereinafter.

Figure 13:
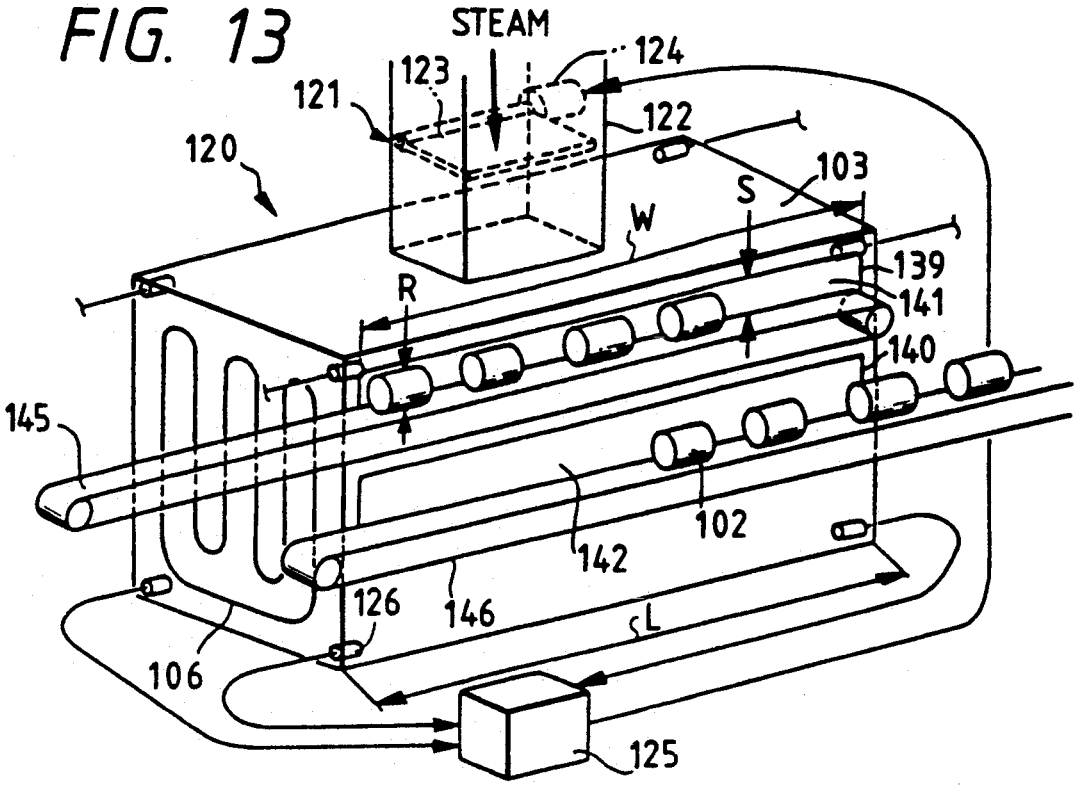
FIG. 13 is a perspective view for showing another preferred embodiment of a package stock device of the present invention.
Figure 14:
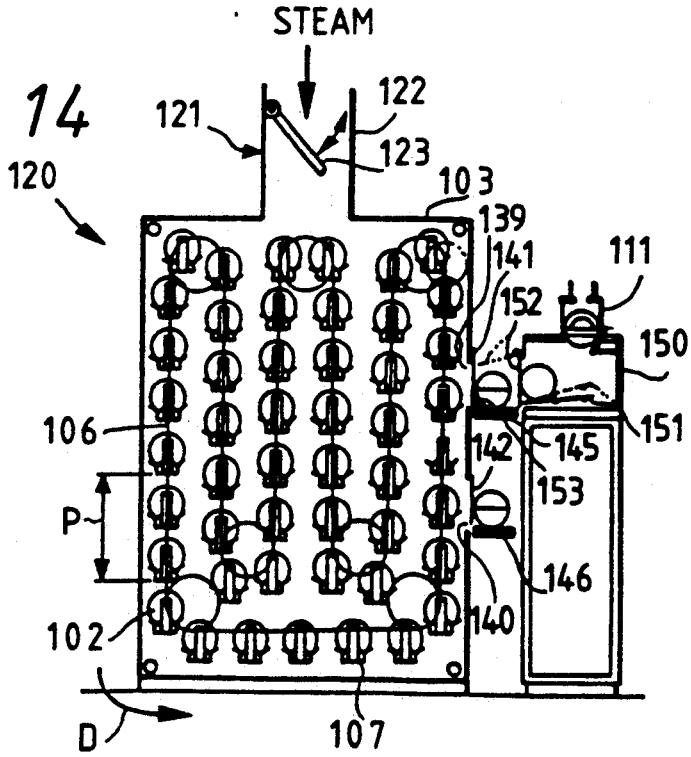
FIG. 14 is a side elevational view for showing the embodiment of the package stock device.

As shown in FIGS. 13 and 14, a place for storing the packages 102 of the package stock device 120 of the present invention is defined and partitioned by a stock case 103 of a hollow rectangular parallelpiped. An upper wall of the case 103 is provided with a steam supplying means 121. In case of a preferred embodiment, the steam supplying means 121 is comprised of a humidifying duct 122 connected to a steam generating device (not shown) and this steam supplying means is fixed at an opening of the upper wall of the case 103. Within this humidifying duct 122 is attached a damper 123 for adjusting an amount of steam flowing in it in such a way as the damper may be opened or closed. A damper driving device 124 is connected to a control device 125 such as a micro-computer. Although the humidifying duct 122 has been employed as the steam supplying means 121, a humidifier may be arranged at the upper wall of the case 103. In addition, the upper and lower four corners within the case 103 have temperature and humidity sensors 126 for detecting a temperature and humidity within the case 103 humidified by the humidifying duct 122. Each of these sensors 126 is connected to the control device 125. The temperature sensor and the humidity sensor may be integrally combined to each other, or separate type of temperature sensor or humidity sensor may also be applied and their number or installation positions may be properly set in response to the size of the case 103.

Figure 16:
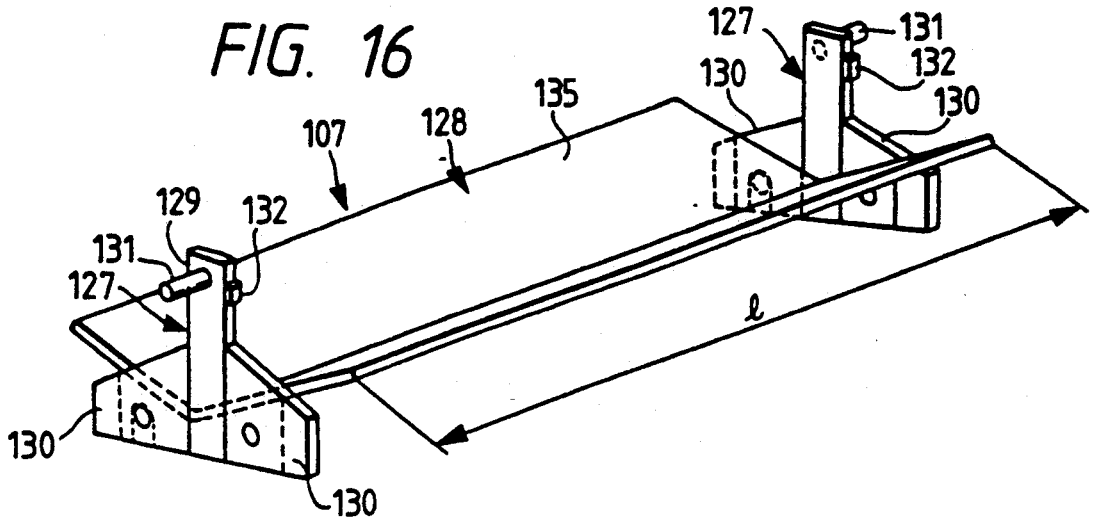
FIG. 16 is a perspective view for showing a package mounting shelf employed in the package stock device.
Figure 17:
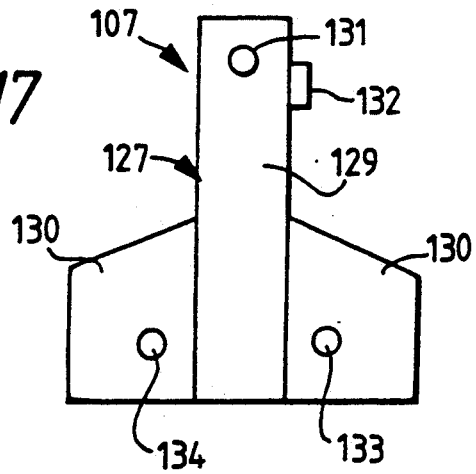
FIG. 17 is a side elevational view for showing a hanger member of the package mounting shelf.
Figure 18:
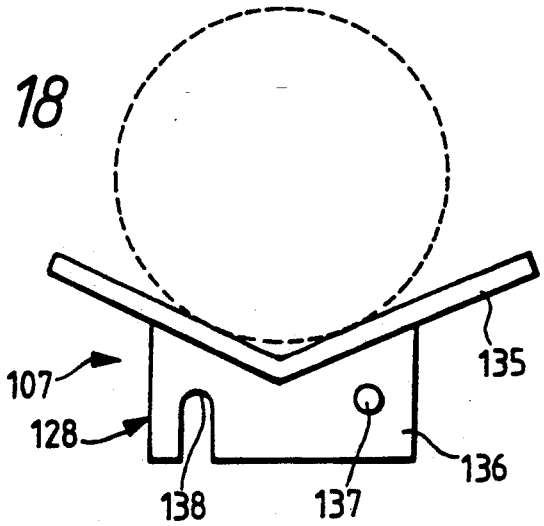
FIG. 18 is a side elevational view for showing the mounting member of a package mounting shelf.
Figure 19:
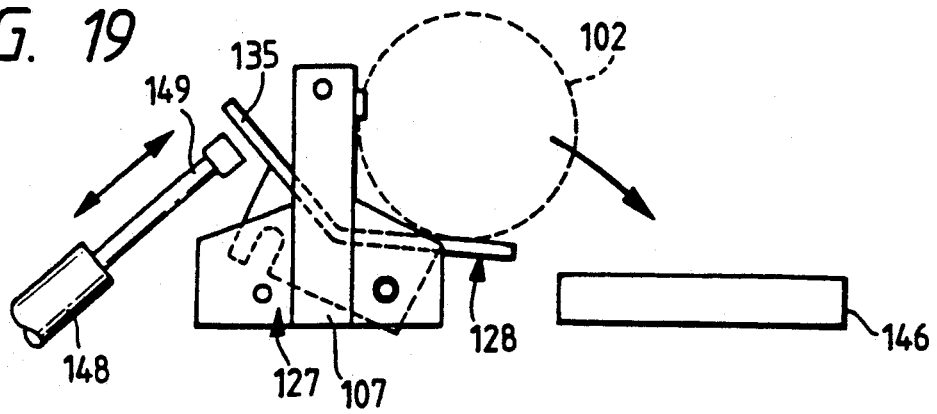
FIG. 19 is an illustrative view for showing a discharged state of package from the package stock device.

At both sides within the case 103 are arranged endless chains 106 in which annular chains are formed in to a mountain-shape through seven sprockets 110, circulated and moved in the case. One of the sprockets 110 is provided with a driving device (not shown). To the endless chains 106 arranged at both sides within the case 103 are hung and fixed a plurality of package mounting shelves 107 for use in mounting the packages 102. As shown in FIGS. 16 to 18, the package mounting shelves 107 are comprised of hangers 127 for use in hanging the mounting shelves 107 to the endless chains 106 and of mounting portions 128 for use in mounting the packages 102. The hanger 127 is comprised of a main body 129 of hanger of straight shape and wide-expanded members 130 of trapezoid expanded at lower both sides of the main body 129 of the hanger. The upper part of the main body 129 of the hanger is formed with a fixing pin 131 for use in fixing the hanger part 127 to the endless chain 106 adjacent to the side wall of the case 103. On the front side of the case, a mark chip 132 indicating type, yarn count, diameter and the like of a package 102 which is mounted on the mounting shelves 107 is attached over the main body 129. In addition, a supporting hole 133 is formed at a front side of each of the expanded width members 130 and an engaging pin 134 is formed at a rear surface adjacent to an inside part of the case 103. The mounting part 128 is comprised of a shelf member 135 having a cross sectional shape of V in order to mount the package and of supporting members 136 for fixing the shelf member 135 to the hanger part 127. A longitudinal length of the case 103 is decided by a longitudinal length l of the shelf member 135 and the length ( of this shelf member 135 is defined by the number of longitudinal rows of packages 102 mounted at once. The supporting members 136 are arranged in flush with longitudinal both ends of the shelf member 135, a supporting pin 137 passed through the supporting hole 133 of the hanger part 127 is formed at a front side and a recess 138 engaged with an engaging pin 134 of the hanger 127 is formed at a rear surface. That is, as shown in FIG. 16, the mounting part 128 is fixed while being held by the hanger member 127 and the mounting part 128 is rotated toward the front side of the case 103 by a method wherein the recess 138 is removed from the engaging pin 134 around the supporting pin 137 as shown in FIG. 19.

In addition, an upper part of the front side of the case 103 is formed with a supplying port 139 for supplying the package 102 within the case 103, and the lower part of it is provided with a discharging port 140 for discharging the package 102 from the case 103. That is, the discharging port 140 is formed adjacent to a rear side of an advancing direction D of the endless chain 106 of the supplying port 139. These supplying and discharging ports 139 and 140 have a larger opening width S than a diameter R of the package 102 and have a larger opening length W than the length l of the shelves 128 of the package mounting shelves 107. In case of the preferred embodiment, the supplying port 139 and the discharging port 140 are arranged at the same side of the case 103 and arranged adjacent to each other through a shelf hanging pitch P of about two mounting shelves 107.

Figure 15:
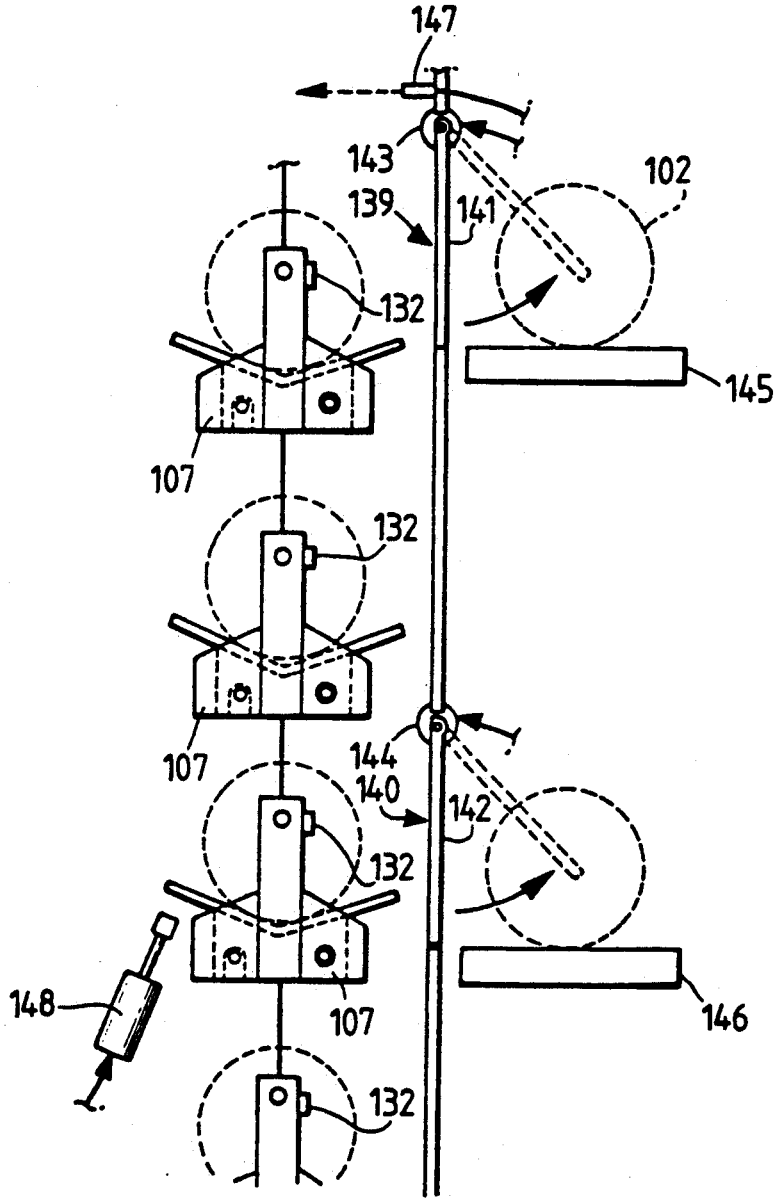
FIG. 15 is an illustrative view for showing a substantial part of the package stock device.
Figure 20:
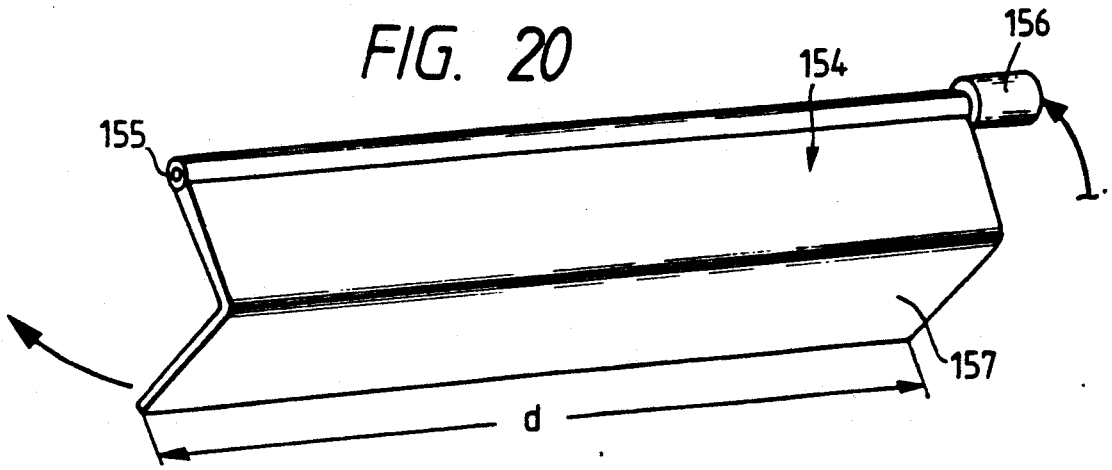
FIG. 20 is a perspective view for showing a pusher employed in the package stock device.

In addition, as shown in FIG. 15, a supplying port 139 and a discharging port 140 are provided with opening or closing doors 141 and 142 in such a way as they may be rotated and each of the door driving devices 143 and 144 is connected to the control device 125. The supplying port 139 is provided with a supplying conveyor 145 for use in transporting the packages 102 having just finished the winding operation to the supplying port 139. The discharging port 140 is provided with a discharging conveyor 146 for use in transporting the packages stored within the case 103 from the discharging port 140 to a subsequent stage such as a twisting stage and the like. An upper front wall of the case 103 of the supplying port 139 is provided with a mark sensor 147 for reading a mark chip 132 adhered to a hanger part 127 of the package mounting shelf 107. This sensor 147 is connected to the control device 125. This mark sensor 147 may also be added to the discharging port 140 and two of them may be applied. As shown in FIGS. 15 and 20, near the discharging port 140 within the case 103 is arranged a shelf pusher 148 acting as a driving means for rotating the mounting part 128 of the package mounting shelf 107 to a front surface of the case 103 around a pivoting point of the supporting pin 137. As this shelf pusher 148, for example, a hydraulic cylinder or a neumatic cylinder and the like are applied and a piston rod 149 of the cylinder pushes up from below the rear surface side of the shelf member 135 and it is connected to the control device 125.

An over-head conveyor 111 for use in transporting the packages 102 just finished for winding operation onto the supplying conveyor 145 is arranged at a prestage of a winding unit of the supplying conveyor 145. A delivery of the package from the over-head conveyor 111 onto the supplying conveyor 145 is carried out by a method wherein the guide plate 151 installed within the conveyor box 150 is inclined toward the supplying conveyor 145. The supplying conveyor 145 of the conveyor box 150 is provided with an opening or closing gate 152 for use in opening or closing a side wall of the conveyor box 150 so as to transport the packages 102 from within the conveyor box 150 one by one onto the supplying conveyor 145. In addition, an edge part of the supplying conveyor 145 is provided with a stopper 153 for preventing the packages 102 transported through the over-head conveyor 111 from falling off the conveyor. When the packages 102 fed from the over-head conveyor 111 are placed at the position of the stopper 153, the opening or closing gate 152 is closed so as to cause a next package 102 to be waited within the conveyor box 150 and this gate 152 is released to open so as to feed in the waiting package when the package 102 is moved from the position of the stopper 153 on the supplying conveyor 145.

Figure 21:
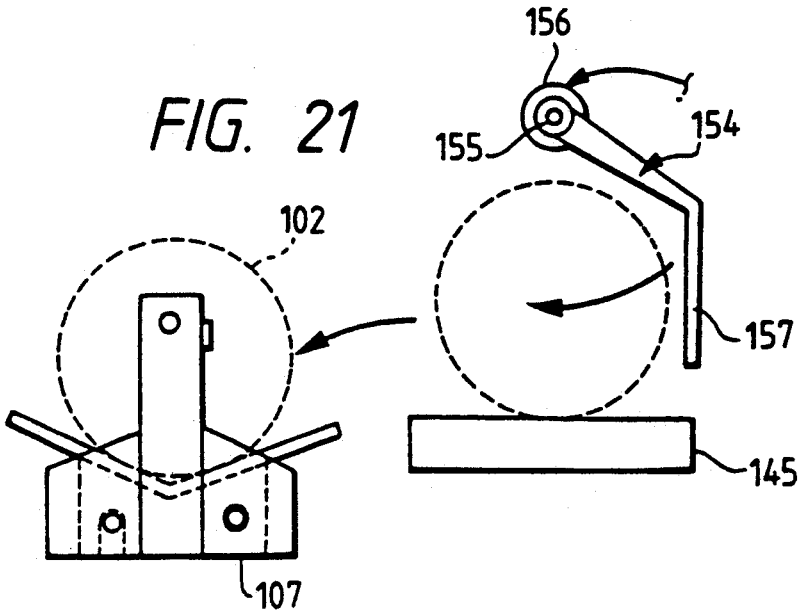
FIG. 21 is an illustrative view for showing a package supplying state for the package stock device.

As shown in FIGS. 20 and 21, the packages 102 are transported in sequence on the supplying conveyor 145 just before the supplying port 139 for the supplying conveyor 145 as described above, and there is provided a package pusher 154 for supplying these groups of packages 102 onto the mounting shelf at once when the packages 102 mounted on the package mounting shelves 107 are arranged in a longitudinal row just before the supplying port 139. This pusher 154 has a cross sectional shape formed into a < -shape and its upper end is provided with a rotating shaft 155. As this rotating shaft 155 is rotated by a driving means not shown, a pushing piece 157 of the pusher 154 may supply a plurality of packages 102 at once onto the mounting shelves 107. A longitudinal length (d) of the pusher 154 is made to have the same length as the longitudinal length ( of the shelf 135.

Action of the preferred embodiment described above will be described as follows.

In case that the packages 102 are stored within the package stock device 120 of the present invention, the damper driving device 124 is driven by the control device 125, the damper 123 of the humidifying duct 122 is released to supply steam within the stock case 103. A temperature and a humidity within the case 103 are detected by temperature and humidity sensors 126 arranged at upper and lower four corners within the case 103, their detected signals are inputted to the control device 125, thereby the control device 125 may set a degree of opening of the damper 123 and adjust it. As shown in FIG. 14, the packages 102 transported from the winding unit and the like over the over-head conveyor 111 are dropped onto an inclining plate 151, and then transported from within the conveyor box 150 onto the supplying conveyor 145 through its inclination. The opening or closing gate 152 arranged at the conveyor box 145 is released when the packages 102 are transported from the box 150 onto the supplying conveyor 145 and it is closed just after it. A stopper 153 arranged in the supplying conveyor 145 may prevent the packages 102 from rolling off the supplying conveyor 145 while being transported. The opening or closing gate 152 is kept closed while the packages 102 are being positioned at the stopper 153, and a subsequent package 102 is waiting within the conveyor box 150. When the packages 102 placed at the stopper 153 are moved on the supplying conveyor 145, the opening or closing gate 152 is released to open and then the waiting packages 102 are transported from within the conveyor box 150 onto the supplying conveyor 145. In this way, the packages 102 are transported in sequence on the supplying conveyor 145 and as the packages 102 to be mounted on the package mounting shelves 107 are arranged in a longitudinal row just before the supplying port 139, as shown in FIG. 21, the shaft driving device 156 is driven by the control device 125, the rotating shaft 155 attached to the upper end of the package pusher 154 is rotated, its pushing piece 157 may push these groups of packages 102 at once and supply them onto the mounting shelves 107. In case of supplying the packages 102 onto the mounting shelves 107, as shown in FIG. 15, the opening or closing door 141 arranged at the supplying port 139 is released to open under a driving action of the door driving device 143 through an instruction from the control device 125. After completion of supplying of the packages 102, the door is closed at once. With this arrangement, steam within the case 103 is not leaked out of the case and a variation of temperature and humidity is also reduced, the mounting shelves 107 having the groups of packages 102 are circulated and moved in sequence by the endless chains 106 of mountain-shape within the case 103 while being ascended or descended. The endless chains 106 are provided with a plurality of package mounting shelves 107. A plurality of packages 102 are mounted in sequence on each of the mounting shelves 107 and circulated and moved within the case 103. Then, the packages 102 are circulated and moved within the case 103 by about one circumference and the mounting shelves 107 having the packages 102 mounted thereon reach the discharging port 140. That is, both storing of the packages and steam processing are carried out simultaneously during circulation and moving operations, and new packages 102 are supplied in sequence onto the mounting shelves 107, resulting in that their processing time is reduced. In the preferred embodiment of the present invention, the packages 102 are mounted on the mounting shelves 107 and just after their moving operation, the mark sensor 147 arranged above the supplying port 139 may read the mark chip 132 attached to the hanger part 127 of the mounting shelf 107. With this arrangement, a type, a yarn count and a diameter of the packages placed on the mounting shelves 107 are read and then their reading signals are inputted to the control device 125. Accordingly, in case that the packages 102 are supplied onto the mounting shelves 107, the packages 102 may be supplied in such a way as this mark chip 132 may coincided with the type, yarn count and diameter of the packages 102. For example, if several kinds of packages 102 are mounted under their classification by their types on the mounting shelves 107, the mark chip 132 is read by the mark sensor 147 and then the circulation and moving time or the number of times of the circulation and moving operation are adjusted by the control device 125 in compliance with each of the types of the packages 102, it may easily be accommodated for several types of steam processing operations.

When the package mounting shelves 107 having completed steam processing operation reach the discharging port 140, the control device 125 may drive the shelf pusher 148. Then, as shown in FIG. 19, the shelf pusher 148 may push up from below the rear surface of the shelf member 135 of the package mounting shelf 107 to cause the mounting part 128 of the mounting shelf 107 to be rotated around a pivoting point of the supporting pin 137 toward the front surface of the case 103 and then the groups of packages 102 mounted on the mounting shelf 107 are discharged onto the discharging conveyor 146 at once. At this time, the opening or closing door 142 arranged at the discharging port 140 is released to open under a driving of the door driving device 144 through an instruction of the control device 125 and it is closed just after a completion of the discharging operation of the packages 102. With this arrangement, in the same manner as that described above, the steam within case 103 is not leaked out of the case and a variation of temperature and humidity is also reduced. Then, the packages discharged onto the discharging conveyor 146 are transported to a subsequent stage such as a twisting stage and the like.

In brief, according to the embodiment of the present invention, the embodiment may provide some superior effects that both storing of the packages and steam processing can be performed continuously, its processing time can be shortened and at the same time the present invention may easily be accommodated for the steam processing for several types of packages.

What is claim is:

1. A yarn package stock device for stocking yarn packages produced by a winding apparatus, the yarn package stock device comprising:

a plurality of package mounting shelves, each package mounting shelf being capable of having at least one yarn package stocked thereon, moving means, including at least one endless chain interconnecting the plurality of package mounting shelves, for moving the plurality of package mounting shelves in a predetermined direction, steam supply means for supplying steam to packages mounted on the plurality of package mounting shelves, a housing for containing the plurality of package mounting shelves and the moving means, the housing including a supply port and a discharge port for respectively supplying packages to and discharging yarn packages from the plurality of package mounting shelves, the supply port being disposed downstream from, and substantially adjacent to, the discharge port on a same side portion of the housing, supply means, substantially adjacent to the supply port, for transporting yarn packages to the housing, discharge means, substantially adjacent to the discharge port, for transporting yarn packages from the housing, humidity sensor means for determining an amount of humidity within the housing, and control means, operably connected to the humidity sensor means, for adjusting an amount of steam supplied by the steam supply means.

2. A yarn package stock device according to claim 1, wherein the supply and discharge ports are each provided with rotatable doors.

3. A yarn package stock device according to claim 2, including means for inserting and removing yarn packages to and from the housing utilizing the supply and discharge ports, respectively, wherein yarn packages inserted into the housing are placed on respective ones of the plurality of package mounting shelves and yarn packages removed from the housing are removed from respective ones of the plurality of package mounting shelves.

4. A yarn package stock device according to claim 1, wherein the steam supply means includes a humidifying duct connected to a steam generating device and a damper for adjusting an amount of steam flowing in the duct, wherein the damper may be opened or closed within the duct.

5. A yarn package stock device according to claim 1, wherein the supply port and the discharge port are separated by a distance less than a length of the endless chain containing approximately four package mounting shelves.

6. A yarn package stock device according to claim 1, wherein the supply port and the discharge port are arranged such that substantially less than approximately five package mounting shelves will be empty during operation.

7. A yarn package stock device according to claim 1, wherein the steam supply means includes a duct, and the control means includes a control device and a damper controlled by the control device, the damper being arranged substantially within the duct.

8. A yarn package stock device for stocking yarn packages produced by a winding apparatus, the yarn package stock device comprising:

a plurality of package mounting shelves, each package mounting shelf being capable of having at least one yarn package stocked thereon, moving means, including at least one endless chain interconnecting the plurality of package mounting shelves, for the plurality of package mounting shelves in a predetermined direction, steam supply means for supplying steam to packages mounted on the plurality of package mounting shelves, a housing for containing the plurality of package mounting shelves and the moving means, the housing including a supply port and a discharge port for respectively supplying packages to and discharging yarn packages from the plurality of package mounting shelves, the supply port being disposed downstream from, and substantially adjacent to, the discharge port on a same side portion of the housing, supply means, substantially adjacent to the supply port, for transporting yarn package to the housing, transfer means for transferring yarn packages from the winding apparatus to the supply means, and discharge means, substantially adjacent to the discharge port, for transporting yarn packages from the housing.

* * * * *